US012781508B2

(12) United States Patent
Mutter et al.

(10) Patent No.: US 12,781,508 B2
(45) Date of Patent: Nov. 3, 2026

(54) EMBER RESISTANT RIDGE VENT

(71) Applicant: William Boone Daniels, II, Henderson, NV (US)

(72) Inventors: David S. Mutter, Santa Rosa, CA (US); Gregory S. Daniels, Santa Rosa, CA (US); William B. Daniels, II, Las Vegas, NV (US)

(73) Assignee: O'Daniels, LLC., Henderson, NV (US)

( * ) Notice: Subject to any disclaimer, the term of this patent is extended or adjusted under 35 U.S.C. 154(b) by 297 days.

(21) Appl. No.: 18/809,251

(22) Filed: Aug. 19, 2024

(65) Prior Publication Data

US 2026/0049475 A1 Feb. 19, 2026

(51) Int. Cl.
*E04D 13/17* (2006.01)

(52) U.S. Cl.
CPC ..... *E04D 13/174* (2013.01)

(58) Field of Classification Search
CPC ... E04D 13/174; E04D 13/176; E04D 13/178; E04D 1/36; F24F 7/02; F24F 7/04
USPC ..... 454/338, 365–367; 52/57, 198, 199
See application file for complete search history.

(56) References Cited

U.S. PATENT DOCUMENTS

| | | | | | |
|---|---|---|---|---|---|
| 2,214,183 | A * | 9/1940 | Seymour | E04D 13/17 | 52/95 |
| 3,481,263 | A * | 12/1969 | Belden | E04D 13/174 | 454/365 |
| 4,418,685 | A * | 12/1983 | Frazier | E04D 13/174 | 126/623 |
| 2008/0220714 | A1* | 9/2008 | Caruso | E04D 13/152 | 454/365 |
| 2023/0243528 | A1* | 8/2023 | Vallery | E04D 13/174 | 454/366 |
| 2024/0183549 | A1* | 6/2024 | Harris | F24F 7/02 | |
| 2025/0244032 | A1* | 7/2025 | Mutter | F24F 7/02 | |

* cited by examiner

*Primary Examiner* — Thomas M Sember
(74) *Attorney, Agent, or Firm* — Paul J. Backofen, Esq.

(57) ABSTRACT

An ember resistant ridge vent has a vent base having a first trough with an inner diverter and an outer diverter and a second trough with an inner diverter and an outer diverter. The first and second troughs are parallel and separated by a primary ventilation opening between their inner diverters. The first and second troughs are joined together by a plurality of straps. A plurality of air control elements are secured in the first and second troughs between the inner and outer diverters in each trough and are operable to impede ember flow through the primary ventilation opening. The ember resistant ridge vent also includes a vent cap operable to cover a portion of the first trough and the air control elements therein, the primary ventilation opening and a portion of the second trough and the air control elements therein, creating a bi-directional ventilation flow path.

16 Claims, 5 Drawing Sheets

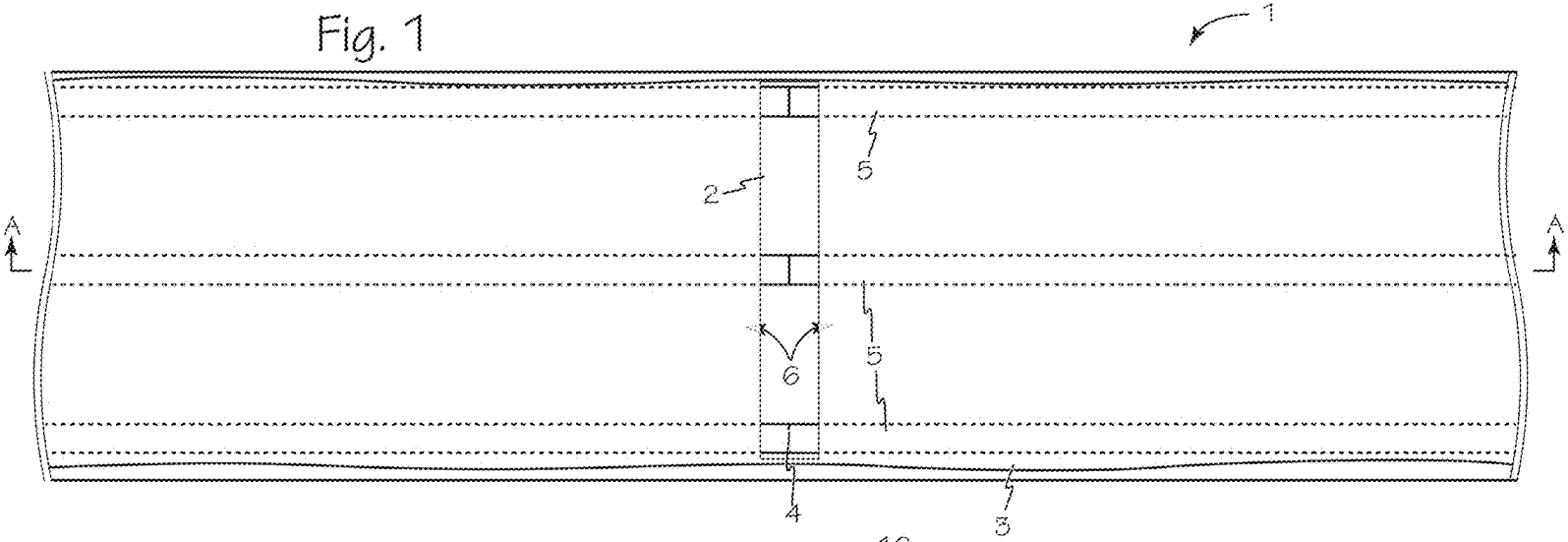
Fig. 1
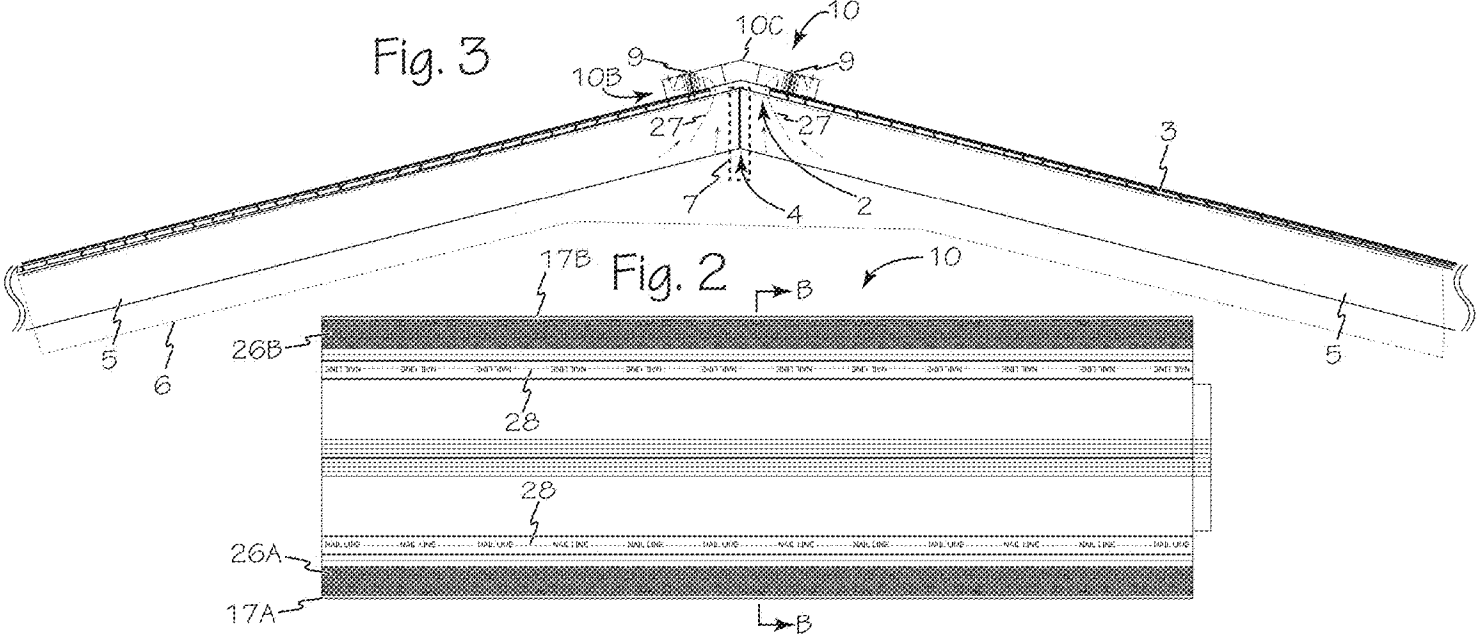
Fig. 2
Fig. 3

EMBER RESISTANT RIDGE VENT

FIELD OF THE INVENTIONS

This invention relates to ventilation systems, more particularly to roof ventilation systems that also help to protect buildings against fires.

BACKGROUND OF THE INVENTIONS

Ventilation of a building has numerous benefits for both the building and its occupants. For example, ventilation of an attic space can prevent the attic's temperature from rising to undesirable levels, which also reduces the cost of cooling the interior living space of the building. In addition, increased ventilation in an attic space tends to reduce the humidity within the attic, which can prolong the life of lumber used in the building's framing and elsewhere by diminishing the incidence of mold and dry rot. Moreover, ventilation promotes a more healthful environment for residents of the building by encouraging the introduction of fresh, outside air. Also, building codes and local ordinances typically require ventilation and dictate the amount of required ventilation. Most jurisdictions require a certain amount of "net free ventilating area," which is a well-known and widely used measure of ventilation.

In many areas, buildings are at risk of exposure to wildfires. Wildfires can generate firebrands, or burning embers, as a byproduct of the combustion of materials in a wildfire. These embers can travel, airborne, up to one mile or more from the initial location of the wildfire, which increases the severity and scope of the wildfire. One way wildfires can damage buildings is when embers from the fire land either on or near a building. Likewise, burning structures produce embers, which can also travel along air currents to locations far removed from the burning structures and pose hazards similar to embers from wildfires. Embers can ignite surrounding vegetation and/or building materials that are not fire-resistant. Additionally, embers can enter the building through foundation vents, under-eave vents, soffit vents, gable end vents, and dormer or other types of traditional roof field vents. Embers that enter the structure can encounter combustible materials and set fire to the building from the inside. Fires also generate flames, which can likewise set fire to or otherwise damage buildings when they enter the building's interior through vents.

SUMMARY

An ember resistant ridge vent has a vent base having a first trough with an inner diverter and an outer diverter and a second trough with an inner diverter and an outer diverter, wherein the first and second troughs are parallel and separated by a primary ventilation opening between their inner diverters and the first and second troughs are joined together by a plurality of straps or other suitable attachment. A plurality of air control elements may be secured in the first and second troughs between the inner and outer diverters in each trough and are operable to impede ember flow through the primary ventilation opening, wherein the air control elements are plurality of nonlinear adjacent baffle/support members. The ember resistant ridge vent also includes a vent cap operable to cover a portion of the first trough and the air control elements therein, the primary ventilation opening and a portion of the second trough and the air control elements therein, creating a bi-directional ventilation flow path through the primary ventilation opening, over the inner diverters, through the plurality of air control elements and past the vent cap and out over the outer diverters.

The air control elements may be a baffle structure or series of baffles, wire mesh, metal wool and or cap supports configured to impede ember flow through the primary ventilation opening while optimizing net free ventilation area. The baffle structures including a plurality of non-linear adjacent elongated baffle members, and a plurality of adjacent channels, where each channel of the plurality of channels is formed between a corresponding adjacent pair of the baffle members. Optionally an ember impedance structure may be included the first vent member. Each baffle/support may have a regular or irregular surface roughness.

An alternate ember resistant ridge vent includes any suitable screen and or ember impediment between the edges of the vent cap and the outer diverters of the first and second troughs. The ember impediments may be wire mesh screen, metal sheets with holes and or louvers as well as fine metal filament.

BRIEF DESCRIPTION OF THE DRAWINGS

FIG. 1 illustrates a top view of a portion of a roof with a ventilation opening through the deck along the ridge.

FIG. 2 is a top view of an ember resistant ridge vent suitable for covering the ventilation opening in the roof of FIG. 1.

FIG. 3 is a cross-section view of the roof of FIG. 1, taken along A-A, with a cross-section view of the ember resistant ridge vent of FIG. 2, taken along B-B, secured over the ventilation opening.

DETAILED DESCRIPTION OF THE INVENTIONS

Figure 4:
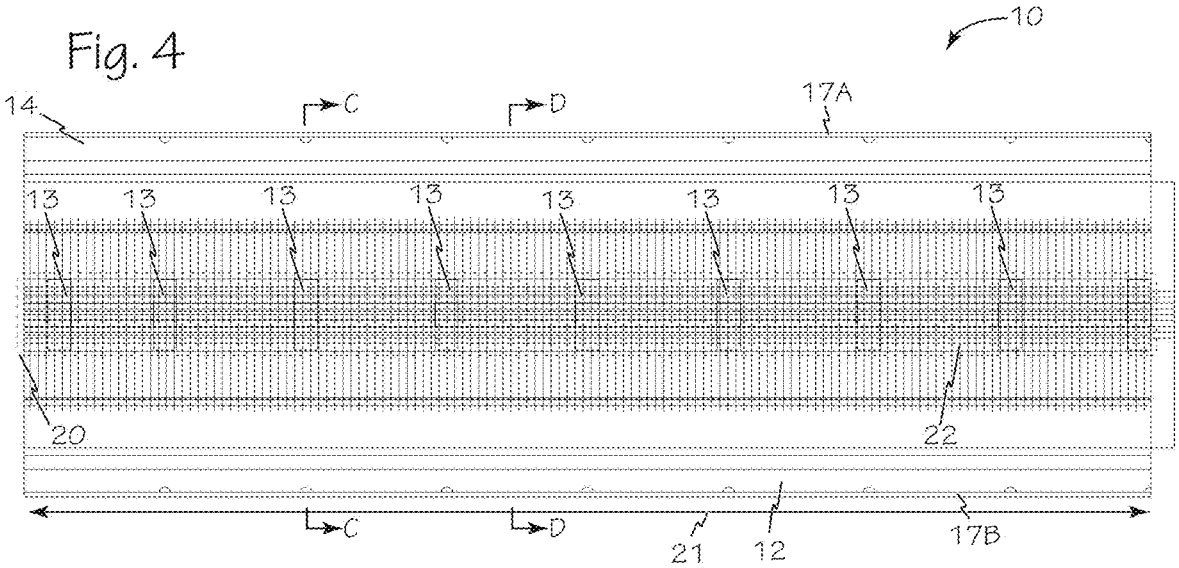
FIG. 4 is a bottom view of the ember resistant ridge vent of FIG. 2.

FIGS. 1 and 3 illustrate a portion of roof 1 with one or more ridge ventilation openings, such as opening 2, through deck or sheathing 3 along ridge 4, above the intersection of rafters 5 for the ventilation of attic or rafter space 6. Ridge 4 may be defined by the joint of counter-sloped rafters at a peak such as with a truss framed roof or it may be identified by the presence of a ridge beam 7 between counter-sloped rafters at a peak as in a conventional framed roof. The roof may have battens, bare rafters or any other suitable building technique, instead of sheathing 3.

FIG. 2 is a top view of an ember resistant ridge vent 10 suitable for covering ventilation opening 2 in the roof of FIGS. 1 and 3. A cross-section of ember resistant ridge vent 10 is illustrated in FIG. 3 secured in fluid communication with ventilation opening 2 in the roof 1.

Figure 5:
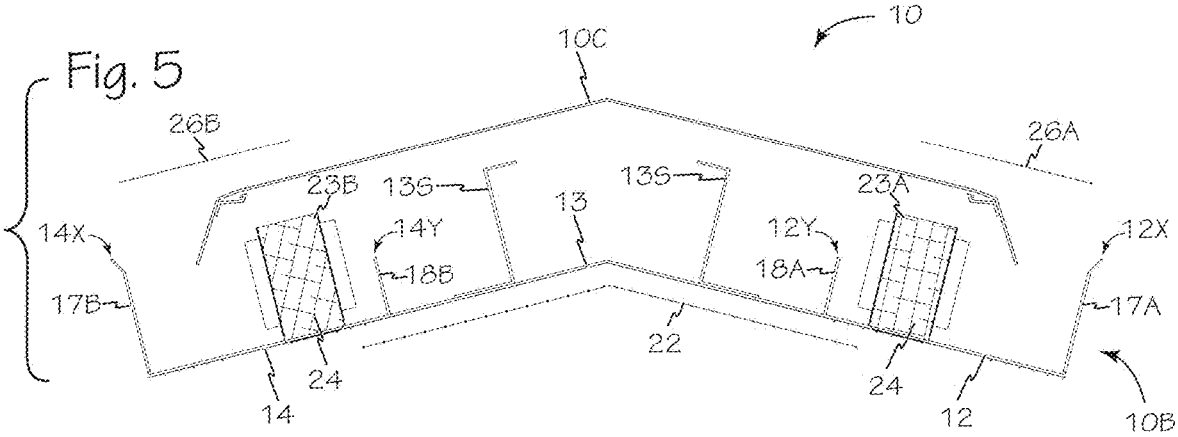
FIG. 5 is an exploded cross-section of the ember resistant ridge vent of FIG. 4 taken along C-C.
Figure 6:
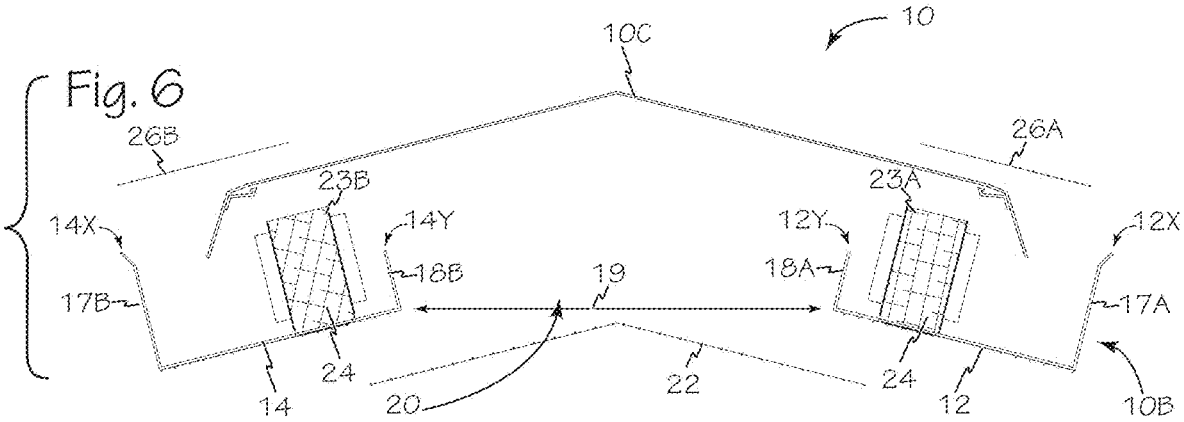
FIG. 6 is an exploded cross-section of the ember resistant ridge vent of FIG. 4 taken along D-D.
Figure 7:
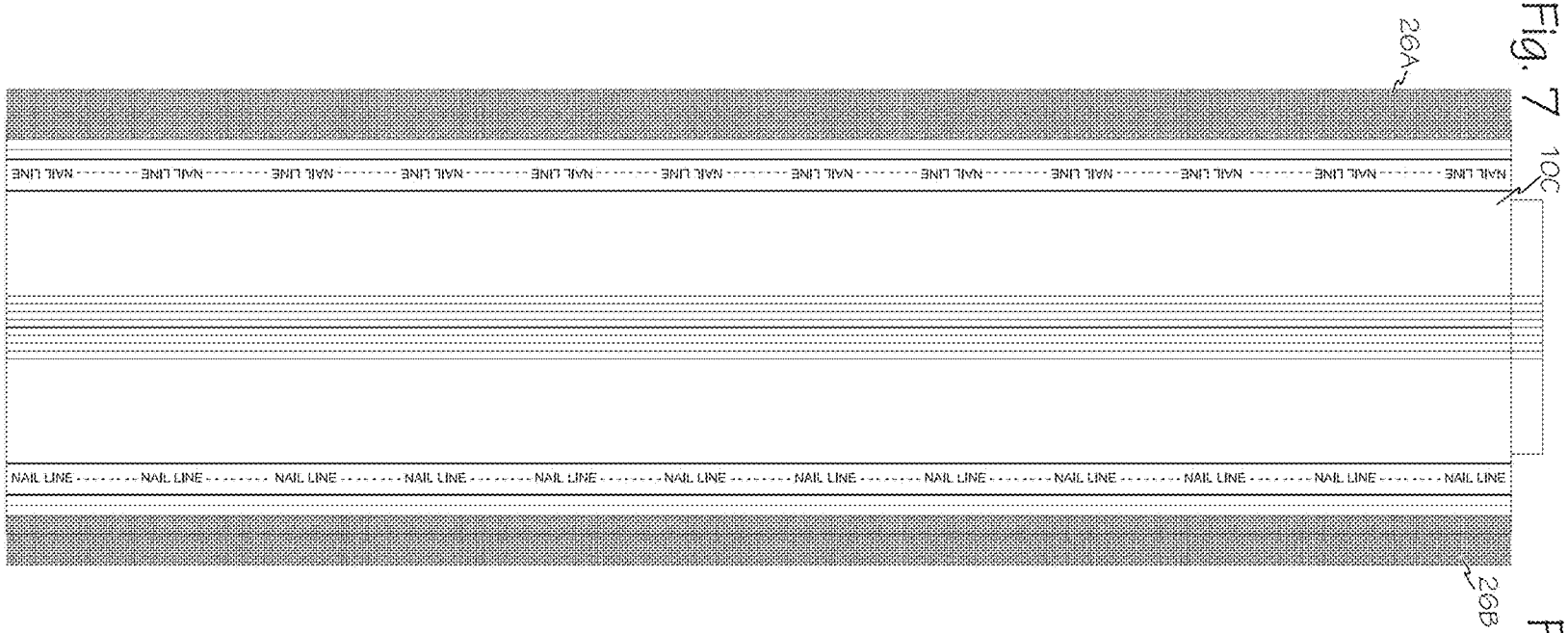
FIG. 7 is a top view of the vent cover of the ember resistant ridge vent of FIG. 2.
Figure 8:
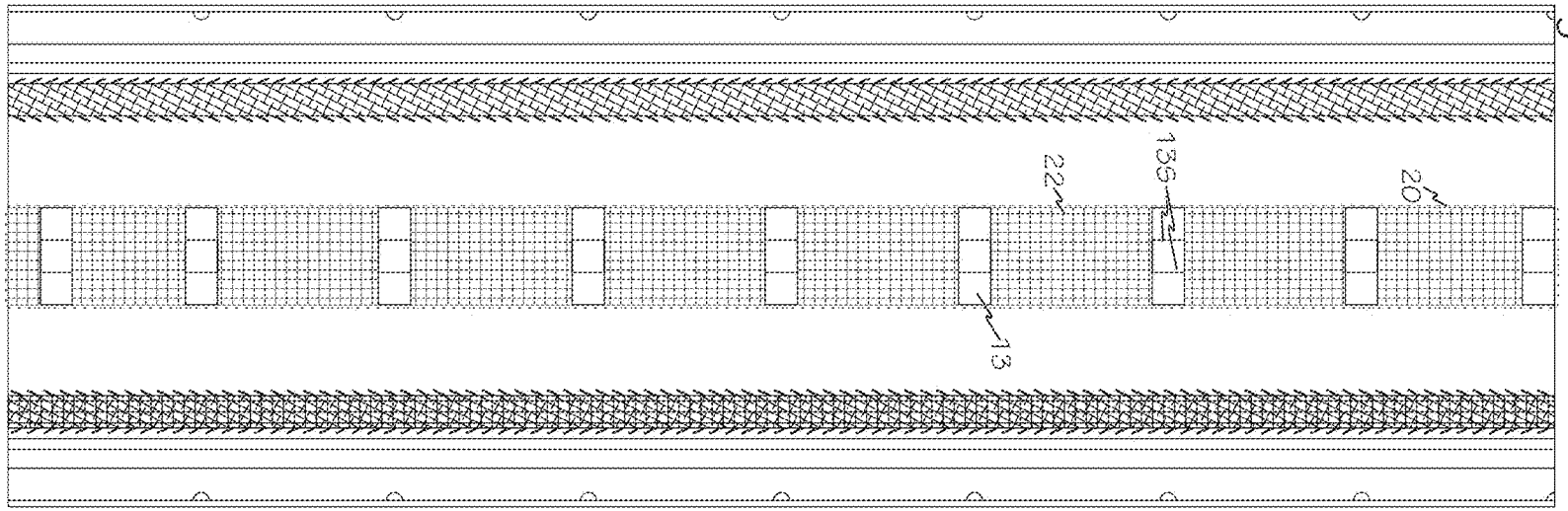
FIG. 8 is a top view of the ember resistant ridge vent of FIG. 2 with the vent cover removed.

Ember resistant ridge vent 10 is additionally illustrated in FIGS. 4, 5 and 6. FIG. 4 is a bottom view of ember resistant ridge vent 10 illustrated in FIG. 2. FIG. 5 is an exploded cross-section of the ember resistant ridge vent of FIG. 4 taken along C-C. FIG. 6 is an exploded cross-section of the ember resistant ridge vent of FIG. 4 taken along D-D. Ember resistant ridge vent 10 has a vent body 10B and a vent cover 10C. Ember resistant ridge vent body 10B, illustrated in FIGS. 3, 4, 5, 6 and 8, includes two parallel troughs, first trough 1213 and second trough 14 joined together by a plurality of connecting straps 13. Each connecting strap 13 is operably connected to one or more support spacers 13S that support vent cover 10C. First trough 12 and second trough 14 may be secured together with any suitable technique, device or apparatus for example, screen, bars, arms, metal strips, channels, posts or other.

Each trough, first trough 12 and second trough 14 is formed of a base, 12B and 14B respectively. Each trough base such as trough base 12B has an outer edge 12*x* and an inner edge 12Y which are folded to be perpendicular to the plane of the trough base and form, in this case, first outer diverter 17A and first inner or water diverter 18A. Similarly, trough base 14B has an outer edge 14*x* and an inner edge 14Y which are folded to be perpendicular to the plane of the trough base and form, in this case, second outer diverter 17B and second inner or water diverter 18B. The inter-trough distance 19 between the parallel troughs defines the primary ventilation aperture 20 which extends the length 21 of ember resistant ridge vent 10. Primary ventilation aperture is optionally covered by any suitable filter such as non-combustible, corrosion resistant wire mesh.

First trough 12 and second trough 14 contain any suitable passive air filtration and control apparatus such as a series of baffles, channels or any other suitable array of air control elements or air filtration bars to optimize net free ventilation area, such as first air filtration bar 23A and second air filtration bar 23B. First and second air filtration bars are louvered metal channels filled with fine stainless steel flexible wire filament wool or fuzz such as steel wool 24. Any series of baffles, channels or any other array of air control elements or filtration bars may also include one or more pads of fine stainless steel flexible wire filament wool or fuzz. The present configuration also includes one or more strips of wire mesh as edge filters, such as edge filters 26A and 26B extending from the vent cover 15 to the first and second outer diverters 17A and 17B respectively.

In use, ember resistant ridge vent base 10B is positioned on roof deck 3 with first trough 12 and second trough 14 on either side of ventilation opening 2 putting primary ventilation aperture 20 in fluid communication with ventilation opening 2 as illustrated in FIG. 3. Vent cover 10C is secured to the vent base 10B and the roof deck 3 using any suitable fasteners. Connecting the base and cap of the ember resistant ridge vent 10 forms bi directional ember resistant ventilation paths 27. Vent cover 10C is secured to the vent base 10B and the roof deck 3 by driving any suitable fastener such as a screw or a nail through the vent cover 10C, along the nail lines 28, and the vent base 10B into roof deck 3. For example, nails 9 secure vent cover 10C to the vent base 10B and the roof deck 3.

Figure 9:
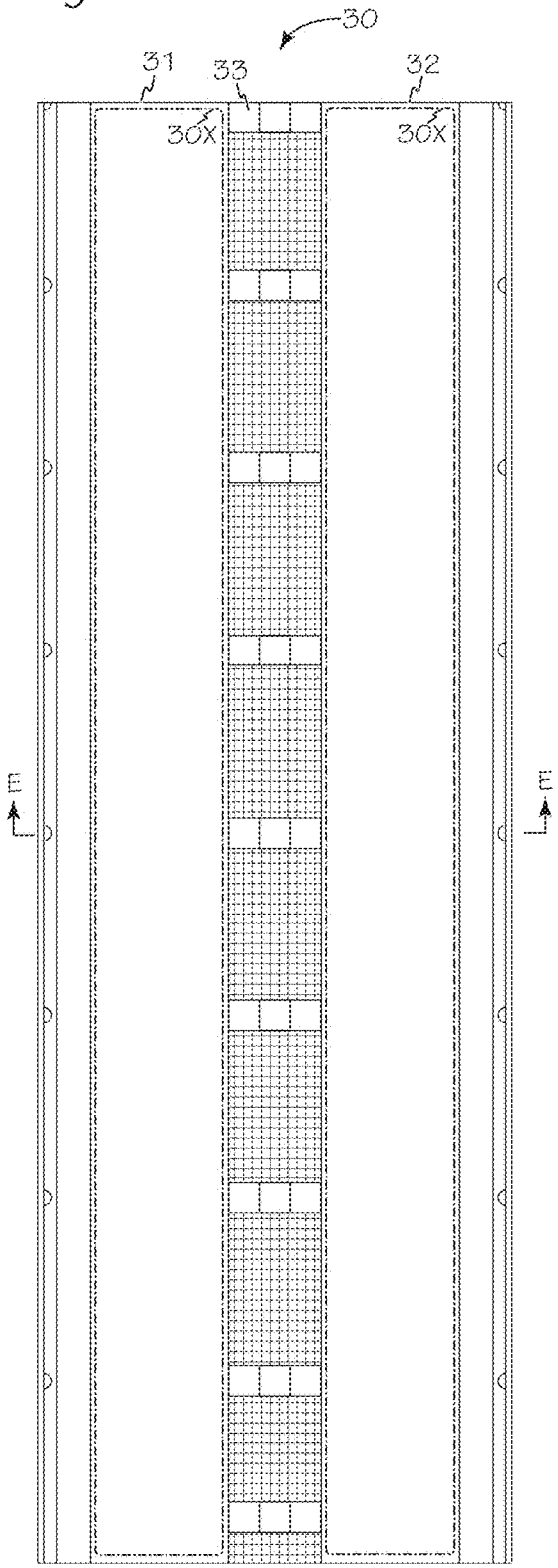
FIG. 9 is a top view of a generic ember resistant ridge vent base with the vent cover removed.
Figure 10:
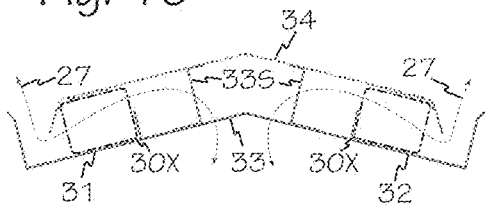
FIG. 10 is a cross-section view of the generic ember resistant ridge vent of FIG. 9 taken along E-E.

FIGS. 9 and 10 illustrate a generic ember resistant vent 30 having a base 30B with a first trough 31 and second trough 32 connected by connecting straps 33. Each connecting strap 33 is operably connected to one or more support spacers 33S that support the vent cover, such as vent cover 34. Additional vent cover support and air flow management is provided by any suitable air flow management system, such as the air filtration bars 23A and 23B of FIGS. 3, 5, 6 and 8, or any suitable combination of baffles and supports, such as the baffles illustrated in FIGS. 11A through 11H, combined with metal screen and/or one or more pads of fine stainless steel flexible wire filament wool or fuzz.

Figure 11A:
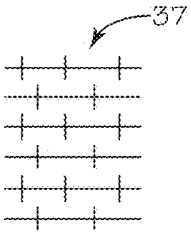
FIGS. 11A-11H are top views of baffles and spacers for air flow control in ember resistant ridge vents.
Figure 11B:
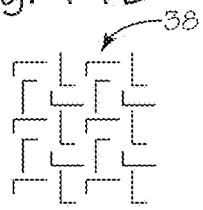
Figure 11C:
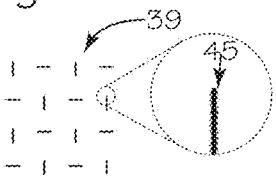
Figure 11D:
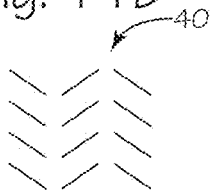
Figure 11E:
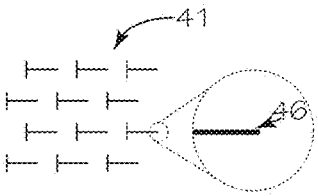
Figure 11F:
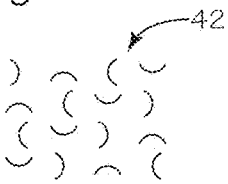
Figure 11G:
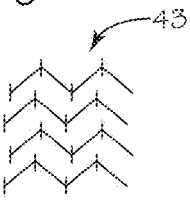
Figure 11H:
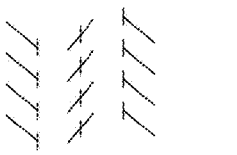

Air control elements 37 of FIG. 11A may be used fill 3-dimensional air flow control area 30X of the generic ember resistant vent to control air flow and optimize net free ventilation area through either or both troughs, such as first trough 31, as well as support vent cover 34. Air control elements may be any suitable plurality of nonlinear adjacent baffle and or spacers or supports, such as baffles 37, 38, 39, 40, 41, 42, 43 and or 44 be used exclusively or in any combination to fill 3-dimensional air flow control area 30X. Baffles and or spacers 37, 38, 39, 40, 41, 42, 43 and or 44 may include small surface structures or suitable surface roughness such as structure 45 or surface roughness 46 to help control air flow through the vent and prevent ember ingress through the primary ventilation opening.

Figure 12:
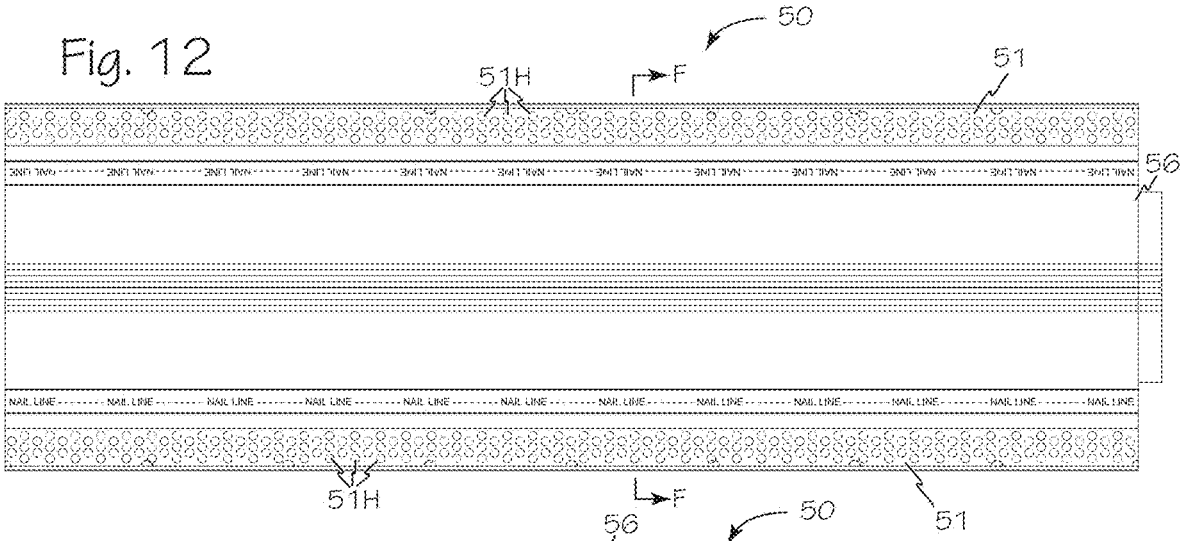
FIG. 12 is a top view of an ember resistant ridge vent with an edge filter of holes in a metal plate.
Figure 13:
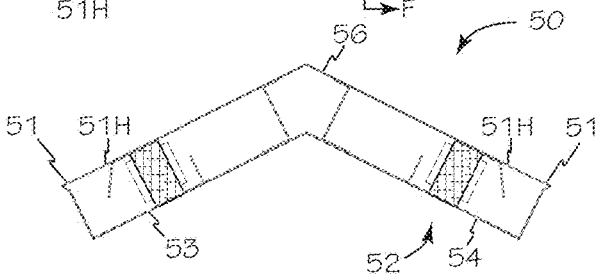
FIG. 13 is a cross-section view of the ember resistant ridge vent of FIG. 12 taken along F-F.

FIG. 12 is a top view of an ember resistant ridge vent 50 having an edge filter 51 having a plurality of ventilation holes 51H. FIG. 13 is a cross-section view of ember resistant ridge vent 50 taken along F-F. The base of any ember resistant ridge vent is formed by two parallel troughs connected by a plurality of straps reaching across the primary ventilation aperture. Here, vent base 52 of ember resistant ridge vent 50 has two parallel troughs, first trough 53 and second trough 54, connected by a plurality of straps, straps 55. The slope of roofs that can be accommodated by this configuration varies from a flat roof to at least a 14:12 pitch. Here ember resistant ridge vent 50 is set to a 6:12 pitch. Edge filters 51 are attached to vent cap 56 and engage the outer diverters of each trough when the vent cap is secured to the roof through the vent base.

Figure 14:
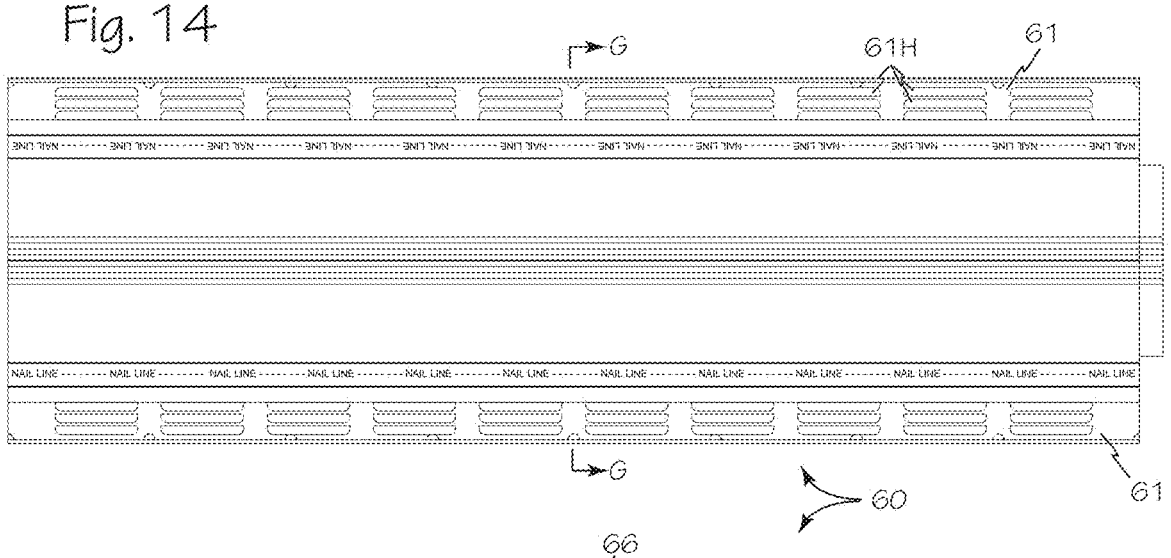
FIG. 14 is a top view of an ember resistant ridge vent with an edge filter and outer diverter having louvers.
Figure 15:
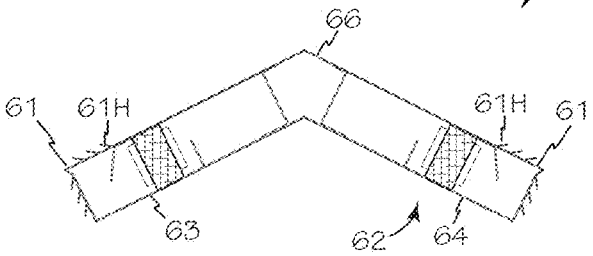
FIG. 15 is a cross-section view of the ember resistant ridge vent of FIG. 14 taken along G-G.

As an alternative to edge filters with holes to provide ventilation, FIG. 14 is a top view of an ember resistant ridge vent 60 having an edge filter 61 and outer diverters having louvers 61H. FIG. 15 is a cross-section view of ember resistant ridge vent 60 taken along G-G. Vent base 62 of ember resistant ridge vent 60 has two parallel troughs, first trough 63 and second trough 64, connected by a plurality of straps, straps 65. Edge filters 61 are attached to vent cap 66 and engage the outer diverters of each trough when the vent cap is secured to the roof through the vent base.

While the preferred configurations of the devices and methods have been described in reference to the environment in which they were developed, they are merely illustrative of the principles of the inventions. The elements of the various configurations may be incorporated into each of the other species to obtain the benefits of those elements in combination with such other species, and the various beneficial features may be employed in configurations alone or in combination with each other. Other configurations and configurations may be devised without departing from the spirit of the inventions and the scope of the appended claims.

We claim:

1. A ridge vent for a roof comprising:

a vent base having a first trough with an inner diverter and an outer diverter and a second trough with an inner diverter and an outer diverter, wherein the first and second troughs are parallel and separated by a primary ventilation opening between their inner diverters and the first and second troughs are joined together by a plurality of straps;

a plurality of nonlinear adjacent baffle/support members secured in the first and second troughs between the inner and outer diverters in each trough and are operable to impede ember flow through the primary ventilation opening; and a separable vent cap operable to cover a portion of the first trough and the air control elements therein, the primary ventilation opening and a portion of the second trough and the air control elements therein, creating a bi-directional ventilation flow path through the primary ventilation opening, over the inner diverters, through the plurality of air control elements and past the vent cap and out over the outer diverters.

2. The ridge vent of claim 1 wherein each of the plurality of nonlinear adjacent baffle members have a rough surface texture.

3. The ridge vent of claim 2 wherein the plurality of nonlinear adjacent baffle members form a plurality of generally parallel serpentine flow paths between the vent openings and the vent outlets.

4. The ridge vent of claim 1 further comprising:

a first edge filter operably connecting the vent cap and the first outer diverter; and a second edge filter operably connecting the vent cap and the second outer diverter.

5. The ridge vent of claim 4, wherein the first and second edge filters are metal screen.

6. The ridge vent of claim 4, wherein the first and second edge filters are metal sheet with holes.

7. The ridge vent of claim 4, wherein the first and second edge filters are metal sheet with louvers.

8. The ridge vent of claim 1 further comprising:

a primary ventilation aperture filter.

9. The ridge vent of claim 8 wherein the primary ventilation aperture filter is wire mesh.

10. A ridge vent for a roof, comprising:

A ridge vent for a roof comprising:

a vent base having a first trough with an inner diverter and an outer diverter joined by a first trough base and a second trough with an inner diverter and an outer diverter joined by a second trough base, wherein the first and second troughs are parallel and separated by a primary ventilation opening between their inner diverters and the first and second troughs are joined together by a plurality of straps and the outer diverters include weep holes where the outer diverters join the first and second trough bases respectively;

a metal mesh cover for the primary ventilation opening;

one or more air control elements secured in the first and second troughs between the inner and outer diverters in each trough and are operable to impede ember flow through the primary ventilation opening;

a separable vent cap operable to cover a portion of the first trough and the air control elements therein, the primary ventilation opening and a portion of the second trough and the air control elements therein, creating a bi-directional ventilation flow path through the primary ventilation opening, over the inner diverters, through the plurality of air control elements and past the vent cap and out over the outer diverters;

a first edge filter operably connecting the vent cap and the first outer diverter; and a second edge filter operably connecting the vent cap and the second outer diverter.

11. The ridge vent of claim 10, wherein the first and second edge filters are metal screen.

12. The ridge vent of claim 10, wherein the first and second edge filters are metal sheet with holes.

13. The ridge vent of claim 10, wherein the first and second edge filters are metal sheet with louvers.

14. The ridge vent of claim 10, wherein the one or more air control elements are air filtration bars.

15. The ridge vent of claim 14, wherein the air filtration bars are louvered metal channels filled with fine stainless steel flexible wire filament wool.

16. The ridge vent of claim 10, wherein the one or more air control elements are nonlinear adjacent baffle/support members.

* * * * *